US010166593B2

(12) United States Patent
Kim et al.

(10) Patent No.: US 10,166,593 B2
(45) Date of Patent: Jan. 1, 2019

(54) MANUFACTURING METHOD FOR BUMPER BEAM OF VEHICLE

(71) Applicants: Hyundai Motor Company, Seoul (KR); Kia Motors Corporation, Seoul (KR); Sungwoo Hitech Co., Ltd., Busan (KR)

(72) Inventors: Hyun Gyung Kim, Whasung-si (KR); Jeong Min Park, Hwaseong-si (KR); Mun Yong Lee, Busan (KR)

(73) Assignees: HYUNDAI MOTOR COMPANY, Seoul (KR); KIA MOTORS CORPORATION, Seoul (KR); SUNGWOO HITECH CO., LTD., Busan (KR)

( * ) Notice: Subject to any disclaimer, the term of this patent is extended or adjusted under 35 U.S.C. 154(b) by 336 days.

(21) Appl. No.: 15/248,860

(22) Filed: Aug. 26, 2016

(65) Prior Publication Data

US 2017/0066037 A1 Mar. 9, 2017

(30) Foreign Application Priority Data

Sep. 7, 2015 (KR) ..... 10-2015-0126543

(51) Int. Cl.

| | |
|---|---|
| ***B21D 53/88*** | (2006.01) |
| ***B21D 22/02*** | (2006.01) |
| ***B21D 47/01*** | (2006.01) |
| ***B21D 5/12*** | (2006.01) |
| *B21D 7/08* | (2006.01) |
| *B21D 35/00* | (2006.01) |

(52) U.S. Cl.

CPC ..... *B21D 53/88* (2013.01); *B21D 5/12* (2013.01); *B21D 22/022* (2013.01); *B21D 22/025* (2013.01); *B21D 47/01* (2013.01); *B21D 7/08* (2013.01); *B21D 35/005* (2013.01)

(58) Field of Classification Search

CPC ..... B21D 53/88; B21D 5/12; B21D 47/01; B21D 7/08; B21D 22/022; B21D 22/025

See application file for complete search history.

(56) References Cited

FOREIGN PATENT DOCUMENTS

| | | | |
|---|---|---|---|
| JP | 2010-179832 | A | 8/2010 |
| KR | 10-2007-0015962 | A | 2/2007 |
| KR | 10-2011-0035699 | A | 4/2011 |
| KR | 10-1395992 | B1 | 5/2014 |
| KR | 10-1530673 | B1 | 8/2015 |

*Primary Examiner* — Moshe Wilensky

(74) *Attorney, Agent, or Firm* — Morgan, Lewis & Bockius LLP

(57) ABSTRACT

A manufacturing method for a bumper beam of a vehicle may include pipe making, producing a circular pipe by pipe molding a steel plate having a predetermined thickness between first and second molding rolls, heating the circular pipe to a set temperature in a heating furnace, pressurizing and molding the circular pipe heated in the heating furnace and having flexibility, while inserting the circular pipe between an upper mold and a lower mold to form a molding beam, and thereafter, rapidly cooling the molding beam to form the molding beam into a high-strength molding beam, and curvature-molding the high-strength molding beam at a predetermined curvature through a curvature molding machine.

13 Claims, 6 Drawing Sheets

MANUFACTURING METHOD FOR BUMPER BEAM OF VEHICLE

CROSS-REFERENCE TO RELATED APPLICATION

The present application claims priority to Korean Patent Application No. 10-2015-0126543, filed Sep. 7, 2015, the entire contents of which is incorporated herein for all purposes by this reference.

BACKGROUND OF THE INVENTION

Field of the Invention

The present invention relates to a manufacturing method for a bumper beam of a vehicle, and more particularly, to a manufacturing method for a bumper beam of a vehicle, in which a circular pipe is molded into a bumper beam having at least two closed cross-sections through hot stamping molding, to remove a welded portion and prevent a non-uniform dent from being generated on a curvature radius direction inner cross-section by heel tap, even in curvature molding.

Description of Related Art

In general, a bumper beam for a vehicle is manufactured by molding a closed cross-section molding beam, molded through a roll forming method, in a predetermined curvature.

The roll forming method makes the closed cross-section molding beam pass through a roll former unit in which roller formers, that constitute an upper molding roll and a lower molding roll as one pair by unwinding coils, are arranged in multiple-stages in a line to bend and mold the molding beam in various shapes. A detailed system and a detailed process of the roll forming method will be described below.

FIG. 1 is a conceptual view of a general roll forming system and a process for each step thereof.

Referring to FIG. 1, in the general roll forming system and the process thereof, an uncoiler 1 that uncoils a supplied coil 10 is configured in the front of a process line to perform an uncoil step S1.

A straightener 2 that straightens a band-type steel plate released from the uncoiler 1 with a flat-plate steel plate plane 20 is provided in the rear of a process direction of the uncoiler 1 to perform a straightening step S2.

A brake press 3 molding holes for various purposes in the steel plate panel 20 supplied from the straightener 2 is provided in the rear of the process direction of the straightener 2 to perform a piercing step S3.

A roll forming unit 4 formed of roll formers R1 to R7 of at least 10 stages or more (not all are illustrated) is disposed in the rear of the process direction of the brake press 3 to perform a roll forming step S4 of roll-molding the steel plate panel 20 supplied through the uncoiler 1, the straightener 2, and the brake press 3 in a shape of a molding beam 30 having a closed cross-section to be obtained through sequential bend-molding.

A laser welder 5 is provided in the rear of the process direction of the roll forming unit 4 and a laser beam output from a laser oscillator 5*a* is irradiated to a welded portion of the molding beam 30 to perform a welding step S5.

In addition, a round bender 6 is provided in the rear of the process direction of the laser welder 5 and the molding beam 30 passes through a multi-stage bending roll unit disposed according to a curvature radius, to be molded to perform a bending step S6 of molding the molding beam into a molding beam 40 having a predetermined curvature.

FIG. 2 is a side configuration diagram of a general round bender.

Referring to FIG. 2, the round bender 6 includes 5-stage bending roll units.

A first-stage bending roll unit BR1 is formed of a pair of bending rolls at upper and lower sides in the front of the process direction on a roll frame 6*a*, to guide the molding beam 30, supplied through a welding step S5, from a molding roll of a rearmost roll former (R7 in FIG. 1) of the roll forming unit 4.

Further, a second-stage bending roll unit BR2 is also formed of a pair of bending rolls at the upper and lower sides in the rear of the process direction of the first-stage bending roll unit BR1 on the roll frame 6*a* to roll-support the molding beam 30 in a curvature radius direction.

In addition, third, fourth, and fifth bending roll units BR3, BR4, and BR5 are sequentially disposed along a curvature radius to be molded in the rear of the process direction of the second-stage bending roll unit BR2 on the roll frame 6*a* and each of the bending roll units is also formed of a pair of bending rolls at the upper and lower sides and the molding beam 30 passes through each bending roll unit to be molded into a molding beam 40 having a predetermined curvature.

Moreover, a cutting press 7 is provided in the rear of the process direction of the round bender 6 to perform a cutting step S7 of cutting the molding beam 40 according to a specification of a finished product for producing the molding beam 40.

FIG. 3 is a perspective view of one example of a buffer beam produced through the general roll forming system and process.

Referring to FIG. 3, a vehicular bumper beam 50 by one example produced through the roll forming system and the process thereof is illustrated and the bumper beam 50 by one example is bent to have closed cross-sections at the upper and lower sides and both ends thereof are laser-welded to be molded at a predetermined curvature.

However, as illustrated in FIG. 3, the conventional bumper beam 50 has a problem in that a plurality of dents D in which depths and generation positions are non-uniform is generated on an inner cross-section having a large width in the curvature radius direction due to heel tap during curvature molding through the round bender 6, thereby reducing collision stiffness.

That is, the dents D are generated by deepening the heel tap during forming the curvature by forming a welded portion by welding both ends of the molding beam 30 in a longitudinal direction in the rear of a front surface during the curvature in the welding step S5.

In the case of the non-uniform dent D, when the bumper beam 50 and a towing hook pipe are assembled, a matching property between a hole H formed on the bumper beam 50 and the towing hook pipe is non-uniform to cause a welding error, and as a result, there is a problem in that an additional welding process needs to be performed through a total inspection of the welded portion in order to secure welding qualities of the bumper beam 50 and the towing hook pipe.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a manufacturing method for a bumper beam of a vehicle, in which a circular pipe is produced by pipe molding at a predetermined temperature is heated and thereafter, molded into a bumper beam having at least two closed cross-sections through hot stamping molding to remove an existing welded portion and prevent a non-uniform dent from being generated on a curvature radius direction inner cross-section by heel tap, even in curvature molding.

According to various aspects of the present invention, a manufacturing method for a bumper beam of a vehicle may include producing a circular pipe by pipe molding a steel plate having a predetermined thickness between first and second molding rolls, heating the circular pipe to a set temperature in a heating furnace, pressurizing and molding the circular pipe heated in the heating furnace and having flexibility, while inserting the circular pipe between an upper mold and a lower mold to form a molding beam, and thereafter, rapidly cooling the molding beam to form the molding beam into a high-strength molding beam, and curvature-molding the high-strength molding beam at a predetermined curvature through a curvature molding machine.

The steel plate may be a cold rolled steel plate having a thickness of 1 mm.

The cold rolled steel plate may have a tensile strength of 550 MPa.

The heating furnace may be a high-frequency heating furnace.

The heating furnace may be an electric heating furnace.

The set temperature may be 900° C.

The molding beam may be a straight beam material in which a lower surface of the molding beam may be formed as a flat horizontal surface by the lower mold, and an upper surface of the molding beam may be molded into a concave portion to contact the lower surface at one side by the upper mold, to form at least two closed cross-sections between the lower surface and the upper surface.

In the high-strength molding beam, the lower surface of the high-strength molding beam may be disposed on an edge of a curvature radius of the high-strength molding beam to be curvature-molded.

The high-strength molding beam may have a tensile strength of 1800 MPa.

According to various aspects of the present invention, a manufacturing method for a bumper beam of a vehicle may include pipe making, of producing a circular pipe by pipe molding a cold rolled steel plate having a thickness of 1 mm between a plurality of molding rolls, heating the circular pipe at 900° C. or higher in a high-frequency heating furnace, and hot stamping, of pressurizing and molding the circular pipe heated in the high-frequency heating furnace and having flexibility, while inputting the circular pipe between an upper mold and a lower mold to produce a molding beam comprising of a straight beam material in which a lower surface is formed as a flat horizontal surface by the lower mold and an upper surface is molded to a concave portion to contact the lower surface at one side by the upper mold and form at least two closed cross-section between the lower surface and the upper surface, and thereafter, rapidly cooling the molding beam to produce a high-strength molding beam, and bending, of curvature-molding the high-strength molding beam at a predetermined curvature through a curvature molding machine.

According to various embodiments of the present invention, a circular pipe produced by pipe molding is heated at a predetermined temperature and thereafter, the circular pipe is molded into a bumper beam having at least two closed cross-sections through a hot stamping molding to remove the existing welded portion, and as a result, the process is simplified by excluding a welding process, and the like to reduce cost.

Further, the thickness of a steel plate which becomes a material can be reduced by 10% or more as compared with the related art due to an advantage in structural rigidity of the circular pipe, and as a result, a collision capability is improved and a weight is reduced.

In addition, a direction of stress concentrated on a curvature radius direction inner cross-section can be distributed even in the curvature molding by removing the existing welded portion to prevent a non-uniform dent from being generated due to heel tap.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
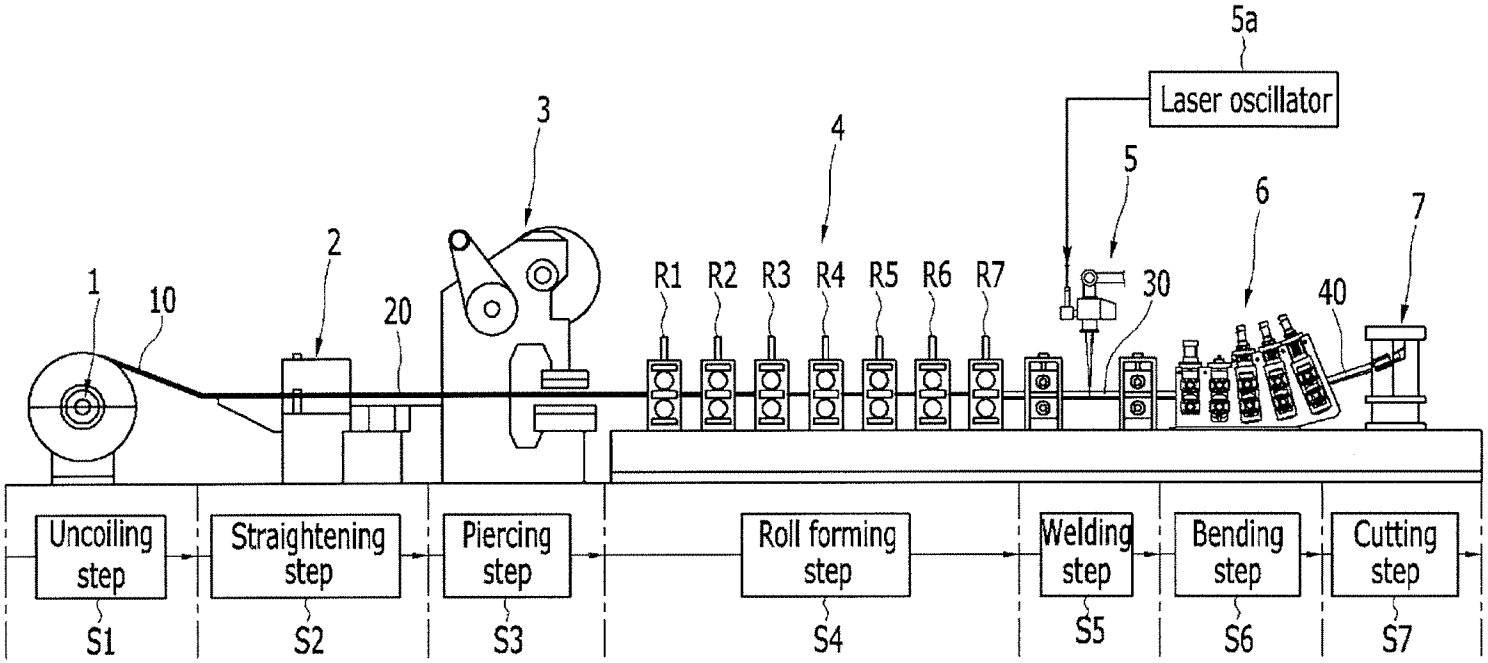
FIG. 1 (Prior Art)
FIG. 1 is a conceptual view of a general roll forming system and a process for each step thereof.
Figure 2:
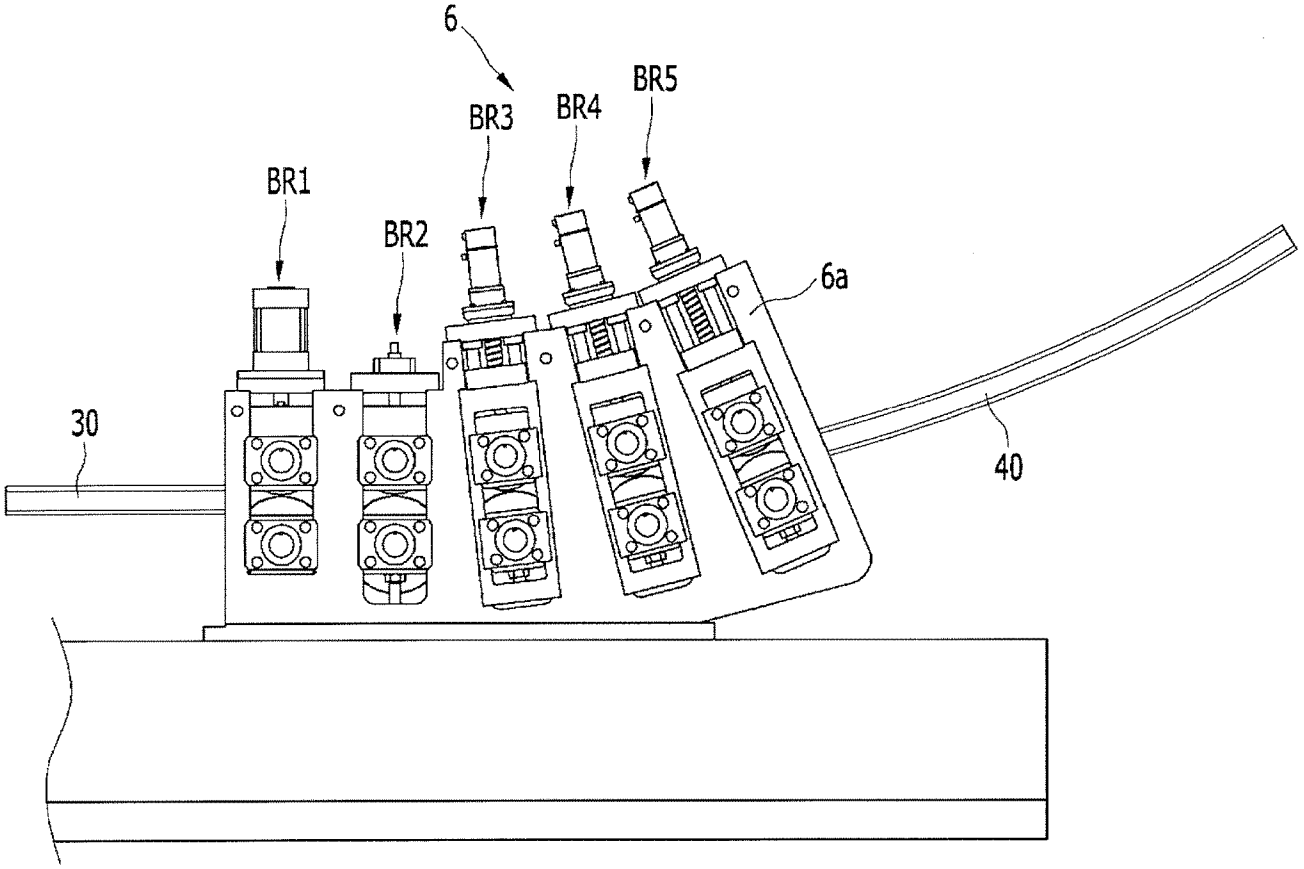
FIG. 2 (Prior Art)
FIG. 2 is a side configuration diagram of a general round bender.
Figure 3:
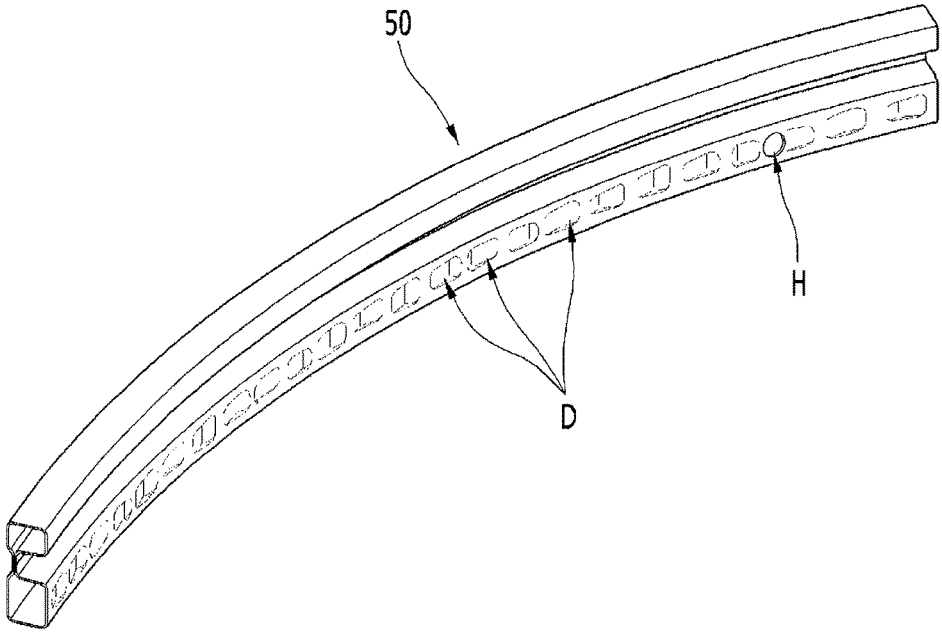
FIG. 3 (Prior Art)
FIG. 3 is a perspective view of one example of a buffer beam produced through the general roll forming system and process.
Figure 4:
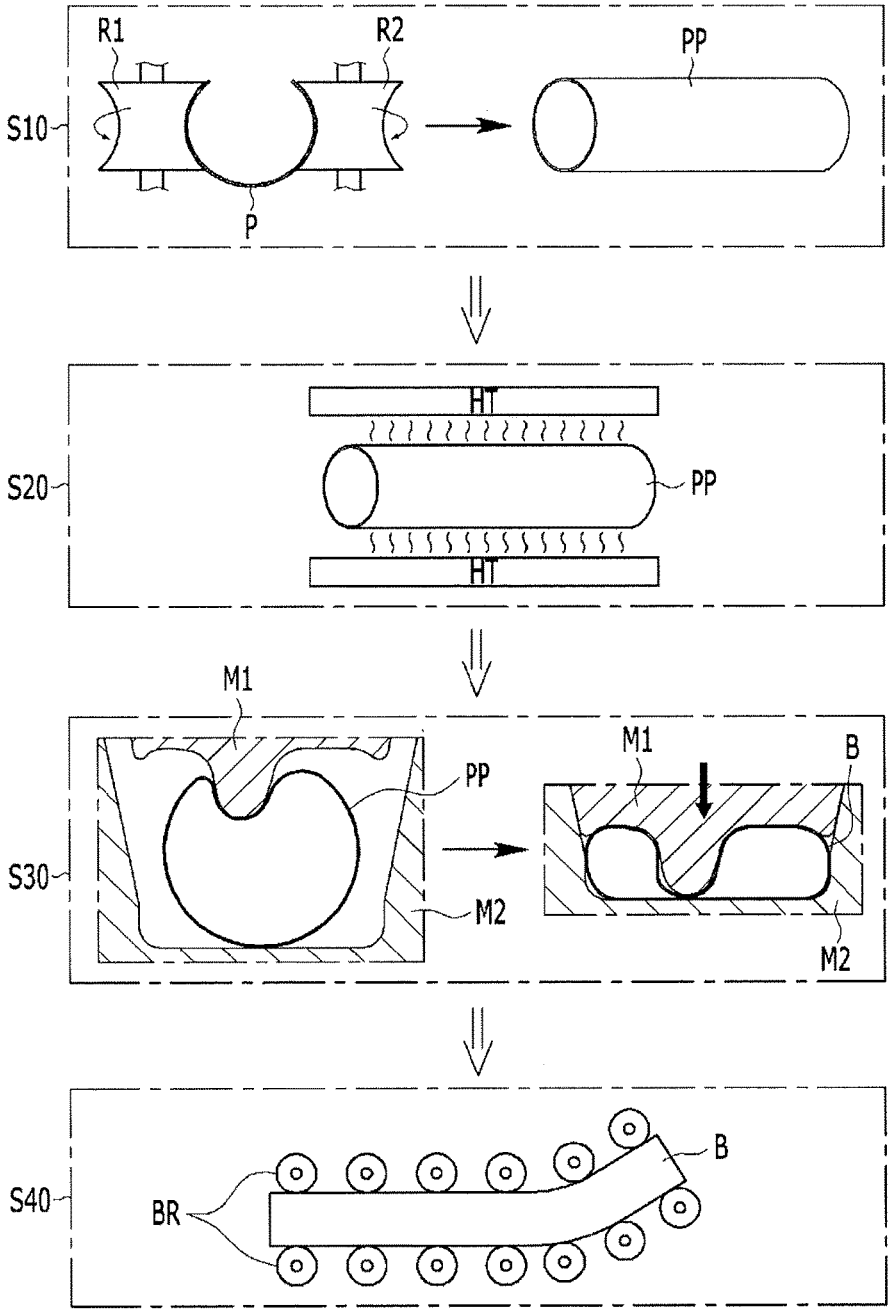
FIG. 4 is a conceptual view of a step-by-step process of a manufacturing method for a bumper beam of a vehicle according to various embodiments of the present invention.
Figure 5:
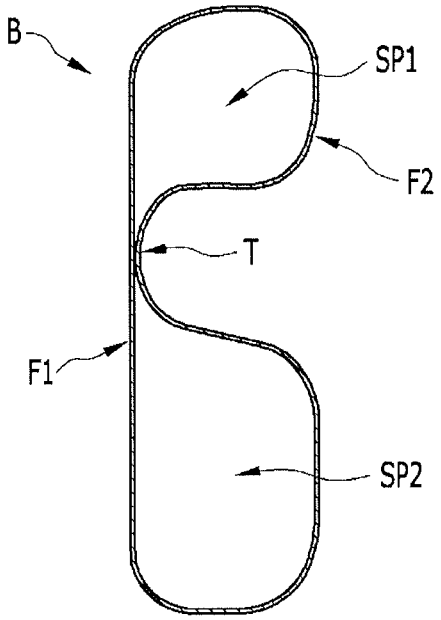
FIG. 5 is a cross-sectional view of a bumper beam manufactured by the manufacturing method for a bumper beam of a vehicle according to various embodiments of the present invention.
Figure 6:
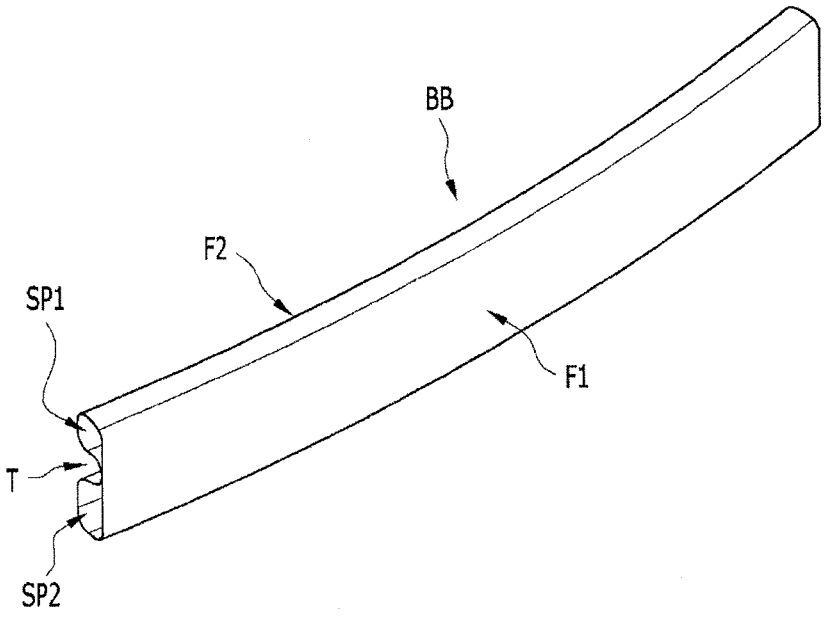
FIG. 6 is a perspective view of the bumper beam manufactured by the manufacturing method for a bumper beam of a vehicle according to various embodiments of the present invention.

FIG. 4 is a conceptual view of step-by-step process of a manufacturing method for a bumper beam of a vehicle according to various embodiments of the present invention, FIG. 5 is a cross-sectional view of a bumper beam manufactured by the manufacturing method for a bumper beam of a vehicle according to various embodiments of the present invention, and FIG. 6 is a perspective view of the bumper beam manufactured by the manufacturing method for a bumper beam of a vehicle according to various embodiments of the present invention.

Referring to FIG. 4, the manufacturing method for molding the bumper beam for the vehicle according to various embodiments of the present invention includes a pipe making process S10, a heating process S20, a hot stamping process S30, and a bending process S40.

First, in the pipe making process S10, a steel plate P having a predetermined thickness is pipe-molded between both molding rolls R1 and R2 to produce a circular pipe PP.

In this case, the steel plate P may be formed of a cold-rolled steel plate having a thickness of 1 mm, but is not particularly limited thereto and a boron steel plate to which boron is added may be adopted.

Herein, a tensile strength of the cold-rolled steel plate may be 550 MPa, but is not particularly limited thereto.

In addition, in the heating process S20 performed subsequently to the pipe making process S10, the circular pipe PP is heated up to a set temperature in a heating furnace HT.

In this case, the heating furnace HT may be a high-frequency heating furnace, but is not particularly limited thereto. For this purpose, a heating furnace HT capable of heating the circular pipe PP to the set temperature within a predetermined time may be adopted, and the heating furnace may be an electric heating furnace.

Herein, the set temperature is preferably 900° C. and the set temperature may be applied differently depending on the material, but in general, in the case of a hot stamping material, unlike the conventional high-strength steel, a steel plate of a ferrite structure having a tensile strength of approximately 500 to 800 MPa before molding is made into austenite and thereafter, high-temperature molded at a high temperature of 900° C. or higher and thereafter, rapidly cooled to be obtained as a martensitic structure having a high tensile strength of approximately 1300 to 1800 MPa.

In addition, in the hot stamping process S30, while the circular pipe PP having flexibility while being heated in the heating furnace HT is input between an upper mold M1 and a lower mold M2, the circular pipe PP is pressurized and molded into a molding beam and thereafter, the molding beam B is rapidly cooled to produce a high-strength molding beam B.

Herein, the upper mold M1 and the lower mold M2 may be formed of general hot stamping molds and referring to FIG. 5, a lower surface F1 of the molding beam B is formed by a flat horizontal surface by the lower mold M2 and an upper surface F2 is molded into a concave portion T so as to contact the lower surface F1 at one side by the upper mold M1, and as a result, the molding beam B is molded to a straight type beam material forming at least two closed cross-sections SP1 and SP2 between the lower surface F1 and the upper surface F2.

In addition, in the bending process S40, the high-strength molding beam B is curvature-molded at a predetermined curvature through a curvature molding machine having a plurality of bending rolls BR.

In this case, referring to FIG. 6, the lower surface F1 is disposed on an exterior of a curvature radius and the high-strength molding beam B is thus curvature-molded and a final high-strength molding beam B produced as such may be applied as a bumper beam BB having a tensile strength of 1800 MPa.

Accordingly, according to the manufacturing method for the bumper beam of the vehicle of the present invention, the circular pipe PP produced by the pipe making molding is heated at the high temperature of 900° C. in the heating furnace HT in the pipe making process S10 and thereafter, molded to the molding beam B having at least two closed cross-sections SP1 and SP2 in the hot stamping mold to secure the strength by the rapid cooling and thereafter, curvature-molded to have a predetermined curvature through the curvature molding machine to be manufactured into a high-strength light vehicular bumper beam BB.

In this case, the circular pipe PP by the pipe making molding is applied as the material for the bumper beam BB and the welded portion welding both ends of the existing steel plate material may be excluded. Therefore, an additional welding process may not be performed, and as a result, the process is simplified to reduce the cost.

While the concave portion T connecting the lower surface F1 and the upper surface F2 of the molding beam B contacts the lower surface F1, the molding beam B is molded to form two closed cross-sections SP1 and SP2 and the thickness of the steel plate which becomes the material may be reduced by 10% or more as compared with the related art due to the advantage of the structural rigidity of the circular pipe PP, and as a result, a capability of withstanding collision can be improved and a weight of the bumper beam BB can be reduced.

In addition, a direction of stress concentrated on the curvature radius direction inner cross-section can be distributed to the concave portion T in the curvature molding by removing the existing welded portion to prevent the non-uniform dent from being generated due to the heel tap.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A manufacturing method for a bumper beam of a vehicle, comprising:

producing a circular pipe by pipe molding a steel plate having a predetermined thickness between first and second molding rolls;

heating the circular pipe to a predetermined temperature in a heating furnace;

pressurizing and molding the circular pipe heated in the heating furnace and having flexibility, while inserting the circular pipe between an upper mold and a lower mold to form a molding beam, and thereafter, cooling the molding beam to form the molding beam into a high-strength molding beam; and curvature-molding the high-strength molding beam at a predetermined curvature through a curvature molding machine.

2. The manufacturing method of claim 1, wherein the steel plate comprises a cold rolled steel plate having a thickness of 1 mm.

3. The manufacturing method of claim 2, wherein the cold rolled steel plate has a tensile strength of 550 MPa.

4. The manufacturing method of claim 1, wherein the heating furnace comprises a high-frequency heating furnace.

5. The manufacturing method of claim 1, wherein the heating furnace comprises an electric heating furnace.

6. The manufacturing method of claim 1, wherein the predetermined temperature is 900° C.

7. The manufacturing method of claim 1, wherein the molding beam comprises a straight beam material in which a lower surface of the molding beam is formed as a flat horizontal surface by the lower mold, and an upper surface of the molding beam is molded into a concave portion to contact the lower surface at a side by the upper mold to form at least two closed cross-sections between the lower surface and the upper surface.

8. The manufacturing method of claim 7, wherein in the high-strength molding beam, the lower surface of the high-strength molding beam is disposed on an edge of a curvature radius of the high-strength molding beam to be curvature-molded.

9. The manufacturing method of claim 1, wherein the high-strength molding beam has a tensile strength of 1800 MPa.

10. A manufacturing method for a bumper beam of a vehicle, comprising:

producing a circular pipe by pipe molding a cold rolled steel plate having a thickness of 1 mm between a plurality of molding rolls;

heating the circular pipe at 900° C. or higher in a high-frequency heating furnace;

pressurizing and molding the circular pipe heated in the high-frequency heating furnace and having flexibility, while inputting the circular pipe between an upper mold and a lower mold to produce a molding beam comprising of a straight beam material in which a lower surface is formed as a flat horizontal surface by the lower mold, and an upper surface is molded to a concave portion to contact the lower surface at a side by the upper mold and form at least two closed cross-section between the lower surface and the upper surface, and thereafter, cooling the molding beam to produce a high-strength molding beam; and curvature-molding the high-strength molding beam at a predetermined curvature through a curvature molding machine.

11. The manufacturing method of claim 10, wherein the cold rolled steel plate has a tensile strength of 550 MPa.

12. The manufacturing method of claim 10, wherein in the high-strength molding beam, the lower surface of the high-strength molding beam is disposed on an edge of a curvature radius of the high-strength molding beam to be curvature-molded.

13. The manufacturing method of claim 10, wherein the high-strength molding beam has a tensile strength of 1800 MPa.

* * * * *